US006004231A

United States Patent [19]

Schickert et al.

[11] Patent Number: 6,004,231

[45] **Date of Patent: *Dec. 21, 1999**

[54] MOLDED FRAME BACKBOARD ASSEMBLY AND METHOD OF MAKING SAME

[75] Inventors: Randy R. Schickert, Kewaskum; David A. Allen, Oconomowoc; Mark E. Davis, Waumatosa; Ronald A. White, N. Prairie, all of Wis.

[73] Assignee: Huffy Corporation, Miamisburg, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/593,321

[22] Filed: Jan. 31, 1996

[51] Int. Cl.[6] ..... A63B 63/08

[52] U.S. Cl. ..... 473/481

[58] Field of Search ..... 473/481, 482, 473/483, 484, 485, 479; D21/201

[56] References Cited

U.S. PATENT DOCUMENTS

| | | | |
|---|---|---|---|
| 3,462,143 | 8/1969 | Bidelman et al. | 473/481 |
| 4,320,896 | 3/1982 | Engle et al. . | |
| 4,424,968 | 1/1984 | Smith . | |
| 4,433,839 | 2/1984 | Simonseth | 473/481 |
| 4,478,415 | 10/1984 | Shaffer . | |
| 4,588,188 | 5/1986 | Mahoney et al. | 473/481 |
| 4,650,188 | 3/1987 | Schroeder | 473/481 |
| 4,739,988 | 4/1988 | Schroeder | 473/481 |
| 4,895,365 | 1/1990 | Schroeder . | |
| 5,114,141 | 5/1992 | Mahoney . | |
| 5,120,054 | 6/1992 | Wetzel . | |
| 5,507,484 | 4/1996 | van Nimwegen et al. . | |

FOREIGN PATENT DOCUMENTS

| | | |
|---|---|---|
| 57-150971 | 9/1982 | Japan . |

*Primary Examiner*—Steven Wong

*Attorney, Agent, or Firm*—Howry & Simon; Michael J. Bell; Andrew R. Kopsidas

[57] ABSTRACT

A molded frame backboard assembly for supporting a rebound member between separately formed front and rear frames such that the peripheral edge of the rebound member is encapsulated within the frame. The rear frame preferably is formed as one piece of plastic material having sufficient strength and rigidity to support the rebound member and may include an internal reinforcing structure integrally molded therewith. The front frame preferably is molded from plastic and has a large central opening providing substantially unobstructed access to the rebound surface of the rebound member. The rear frame includes a recess that locates the rebound member in a predetermined position within the rear frame. The front and rear frame members include cooperating alignment structures that enable the front frame to be easily located on and attached to the rear frame after the rebound member has been positioned within the rear frame.

39 Claims, 20 Drawing Sheets

MOLDED FRAME BACKBOARD ASSEMBLY AND METHOD OF MAKING SAME

BACKGROUND OF THE INVENTION

1. Field of the Invention

The invention relates generally to basketball backboards and, in particular, to a molded frame for a basketball backboard having a rebound member supported between front and rear molded frames.

2. Description of Related Art

Basketball backboards are currently made from a variety of materials, but heretofore have not been made with a molded plastic support frame. Typically, basketball backboards have been provided with a steel or aluminum extruded frame formed from individual sections that are joined to form a support for a backboard rebound member. The frame not only supports the rebound member, but includes holes or the like to facilitate mounting the backboard to a support structure, such as an extension arm or elevator, and a support post. The rebound member has been formed from a plastic material, commonly acrylic. A disadvantage associated with many basketball backboards is that the peripheral edge of the rebound member may be exposed, thereby increasing the risk of cracking when the edge is struck by a basketball or other object.

In one known prior backboard developed by the assignee of this application, the backboard frame comprises four substantially straight extruded aluminum members each having an "F"-shaped cross section defining a pair of parallel flanges and four diecast corner members. The frame members are aligned to wrap around the edge of the backboard with the flanges extending along opposing sides of the backboard and the extruded members connected to the corner members by a fastener. In forming the extruded frame member, the spacing of the flanges must be sufficient to accommodate any tolerance variations in the thickness of the backboard rebound surface. Thus, it is possible for gaps or a loose fit to occur between the existing frame structure and the backboard surface resulting in variations in the amount of rigidity and/or support provided by the frame. The backboard is mounted to a support structure through openings in two of the frame members. The frame members have an open slot extending along the length of each member. At a predetermined position along the slot, an enlarged portion is formed for receiving the head of a mounting bolt associated with the support structure. The head of the bolt is retained within the cross section of the frame, but is slidable along substantially the full length of the support structure during assembly.

Further, the assembly of the above-described backboard structure requires that the frame and backboard surface be moved toward each other in a sideways direction such that the frame is essentially wrapped around the backboard surface during assembly. Thus, assembly of the prior backboard requires that the edge of the backboard surface be aligned with a slot defined between the parallel flanges as the backboard is brought into association with the frame.

Although this multi-piece frame structure has worked well from the standpoint of providing a rigid support for rebounding a basketball, it has certain disadvantages, especially from the standpoint of ease of manufacturing and assembly. In particular, alignment of the eight frame pieces with the rebound member prior to interconnection is a labor-intensive process. Moreover, the use of aluminum to form the frame members is costly. Finally, allowing the backboard support mounting bolts used to slide the entire length of the frame member may make attachment to a support structure difficult.

FIG. 1 schematically illustrates another known basketball backboard construction, which includes a welded steel frame 1 having diagonal supports 2 and a substantially planar acrylic sheet 3. As shown in the simplified side view of FIG. 2, which obviously is not to scale, a rectangular acrylic sheet 3 is attached to frame 1 by a double-sided adhesive layer 5. The sheet 3 has an outer perimeter edge 3*a*, which is completely exposed at all four sides of the sheet. A basketball goal may be mounted to frame 1 by way of holes 4 located through diagonal supports 2. The basketball backboard is attached to a support structure by way of mounting apertures 6 located on diagonal supports 2. The mounting apertures are threaded inserts, which receive a bolt or similar fastener from the support structure.

This type of frame construction suffers from more drawbacks and disadvantages than the aluminum extruded backboard described above. Most notably, is the use of adhesive material, which may not be strong enough to retain the acrylic sheet against the frame for an extended period. Thus, the rebound member may not be sufficiently supported by the backboard frame, thereby decreasing rebounding performance. Additionally, the entire edge of the acrylic sheet is exposed and, therefore, highly susceptible to cracking when the edge is struck by a ball or other object. Once a crack exists, it may propagate throughout the acrylic sheet and compromise the integrity of the backboard assembly. In addition, broken pieces of acrylic can fall from the supporting frame thereby exposing a player to injury. Another disadvantage is the bolt mounting structure. The threaded insert design does not accommodate for variations in the thickness of the particular mounting and support structure employed. Therefore it requires the precise size bolt to successfully attach the backboard to its support. Also, backboards utilizing steel frames are costly to manufacture and possess excessive weight, thereby increasing the requirements for the backboard support assembly, shipping costs, etc.

The foregoing review of the prior art demonstrates a need for a lightweight, yet durable basketball backboard that is easier to manufacture and assemble, less costly to produce than previous metal frame backboards, while at the same time performing as well or better than these prior backboards. Such backboards should also reduce the risk of cracking and the danger that the broken pieces or fragments will escape from the backboard frame.

SUMMARY OF THE INVENTION

The invention meets these needs and avoids the disadvantages and drawbacks of the above-described prior art by providing a basketball backboard preferably having a molded plastic frame for supporting a rebound member having a rebound surface. The frame may be formed by separately moldable front and rear sections such that the rebound member is supported between the frames, and the peripheral edge of the rebound member is completely encapsulated.

The rear frame member may be formed as one piece of plastic material made by any known molding process, but preferably is made by injection molding or with gas assist in combination with a strength-enhancing technique like structurally foaming or fiberglass-reinforcing the plastic. Use of these processes ensures that the rear frame member has sufficient strength and rigidity to support the rebound member and provide rebounding performance that matches or exceeds that of the highest quality metal frame backboards. The rear frame member also may include an internal reinforcing structure integrally molded therewith to further enhance the strength and rigidity of the rear frame.

The rebound member has a substantially planar rebound surface, also preferably formed from a molded plastic material, typically a polycarbonate or acrylic. However, the dual frame construction of the invention enables other types of materials to be used for the rebound member, including wood, fiberglass, laminate, tempered glass and metal.

The front frame member may be formed as one piece of plastic material from any known moldable thermoplastic or thermoset material by injection molding or any other known plastic forming process, but the strength enhancing techniques preferably employed for the rear frame member may not be necessary. The front frame has a large central opening providing substantially unobstructed access to the rebound surface of the rebound member.

The invention also includes several features which facilitate assembly of the backboard in a generally vertically stacked manner. The rear frame member may include a positioning structure, such as a recess or ridge, which enables the rebound member to be dropped into a predetermined position within the rear frame. The front and rear frame members include alignment features that enable the front frame to be easily positioned and attached to the rear frame member by placing it on top of the rear frame after the acrylic sheet has been dropped in place. The alignment features also may include a projecting structure, such as a ridge formed on one of the front and rear frame members, while the other frame member includes a corresponding recess, such as a channel or groove, adapted to receive the projecting member. The alignment features may include bosses projecting from one of the frames and bores located in corresponding locations on the other of the frames such that the bores receive the bosses when the front and rear frames are joined together. Fasteners such as a self-tapping screw may extend through each bore and boss to connect the front and rear frames together, although any conventional technique for locking plastic parts together may be employed.

The rear frame may also includes a slotted structure particularly adapted to connect the backboard to a backboard support mechanism in an easier manner than heretofore possible. Like the prior aluminum frame discussed above, the slot receives the head of a mounting bolt for the backboard support mechanism. However, in the invention the slot may be formed as a keyhole slot, which has a predetermined extent less than the extent of the rear frame. Thus, the mounting bolts may rest on a ledge defining one end of the slot to facilitate assembly.

The invention thus provides new and significant advantages over the prior art. The molded plastic construction of the backboard frame of the invention enables the frame to be lightweight and durable without compromising strength or rigidity. The rebound member is completely encapsulated within the frame such that there are no exposed edges, which can be susceptible to cracking. Moreover, even if cracking does occur, the broken pieces should be trapped within the assembly due to the encapsulation of the rebound member. Because the backboard assembly is formed primarily from three separately moldable parts, assembly of the invention is quickly accomplished, especially with the positioning and alignment features of the invention. Thus, the invention provides a lightweight backboard that is more easily manufacture and assembled than heretofore possible while maintaining or surpassing the performance of prior backboards.

BRIEF DESCRIPTION OF THE DRAWINGS

FIG. 11A is a front plan view of the front frame shown schematically in FIG. 3, while

DETAILED DESCRIPTION

Figure 1:
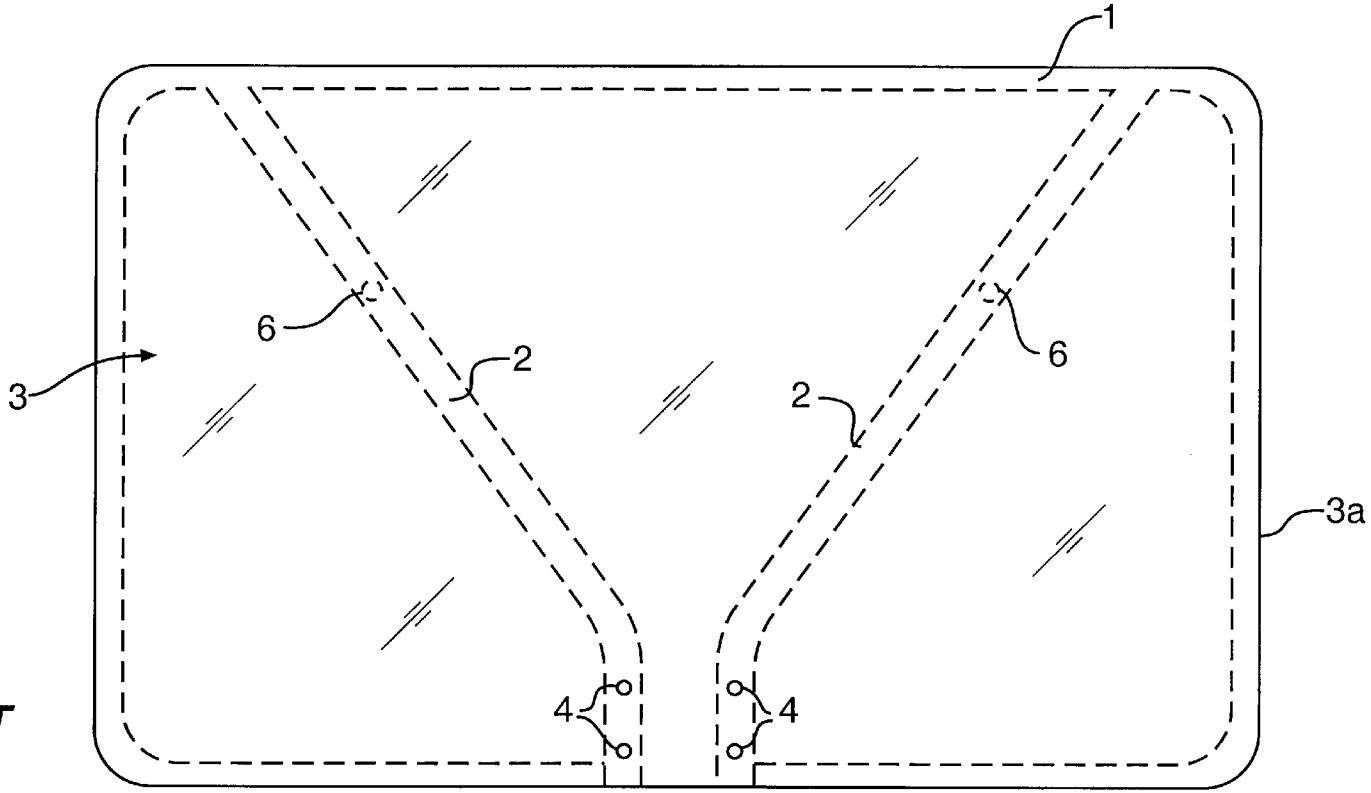
FIG. 1 PRIOR ART
FIG. 1 is a plan view schematically illustrating a prior art backboard.
Figure 2:
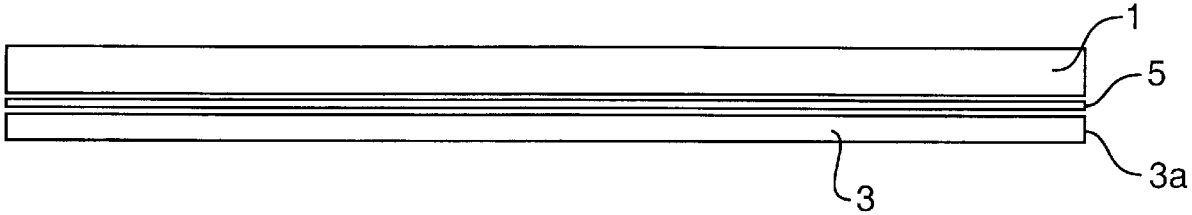
FIG. 2 PRIOR ART
FIG. 2 is an enlarged simplified, elevational view illustrating a side of the prior art backboard shown in FIG. 1.
Figure 3:
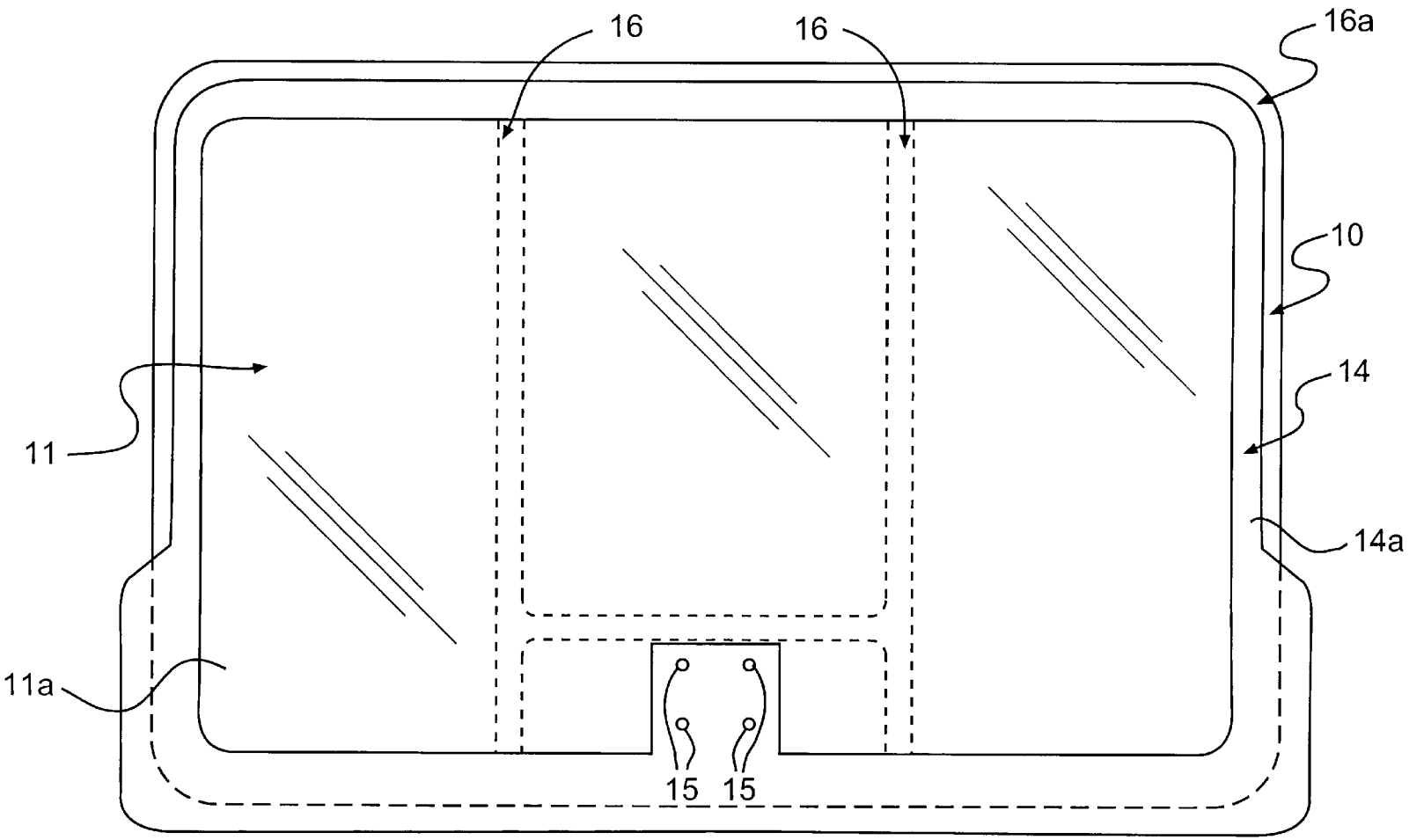
FIG. 3 is a front plan view schematically illustrating a molded frame backboard constructed according to the principles of the invention in which the rebound member is supported between a rear frame and a front frame.

Referring first to FIG. 3, the principles of the invention are schematically illustrated in this simplified view of a composite backboard frame 10, which generally includes a molded plastic frame assembly having a front frame 14 and a rear frame 16 (partially shown in phantom) supporting a rebound member 11. FIG. 3 is for illustration purposes only and is not drawn to exact scale. As will be more apparent from the drawings and description below, the rebound member 11 is trapped between and supported by the rear frame 16 and front frame 14 such that the peripheral edge of the rebound member is completely encapsulated within the frame assembly. Although the backboard assembly 10 and its components are shown as having a substantially rectangular shape, other shapes may be employed easily because the frames and rebound member are preferably molded from plastic described more particularly below. A basketball goal usually in the form of a metal rim or hoop may be mounted to the backboard by way of mounting holes 15 in any conventional manner.

Figure 4:
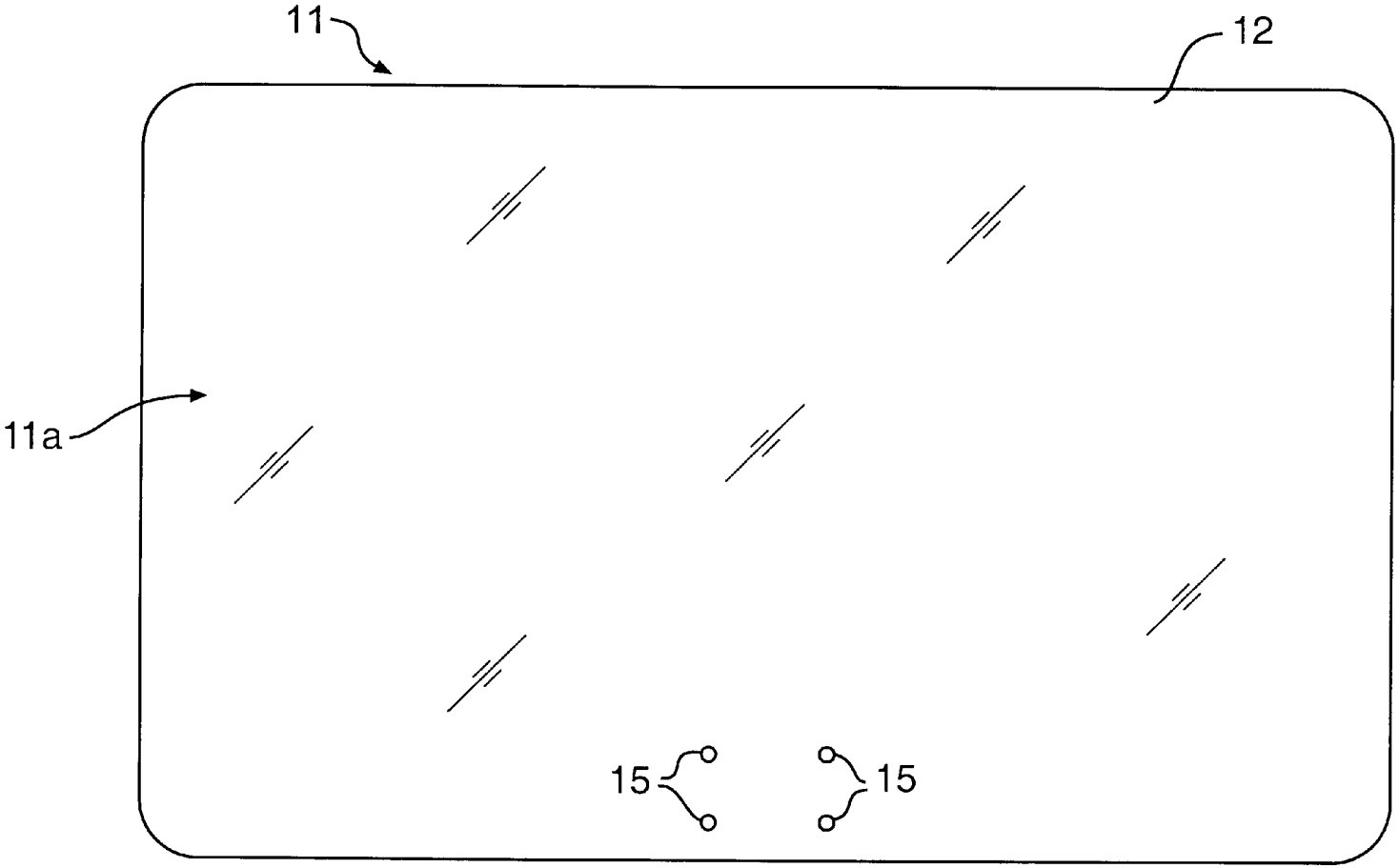
FIG. 4 is a front plan view of the rebound member shown in FIG. 3.
Figure 15:
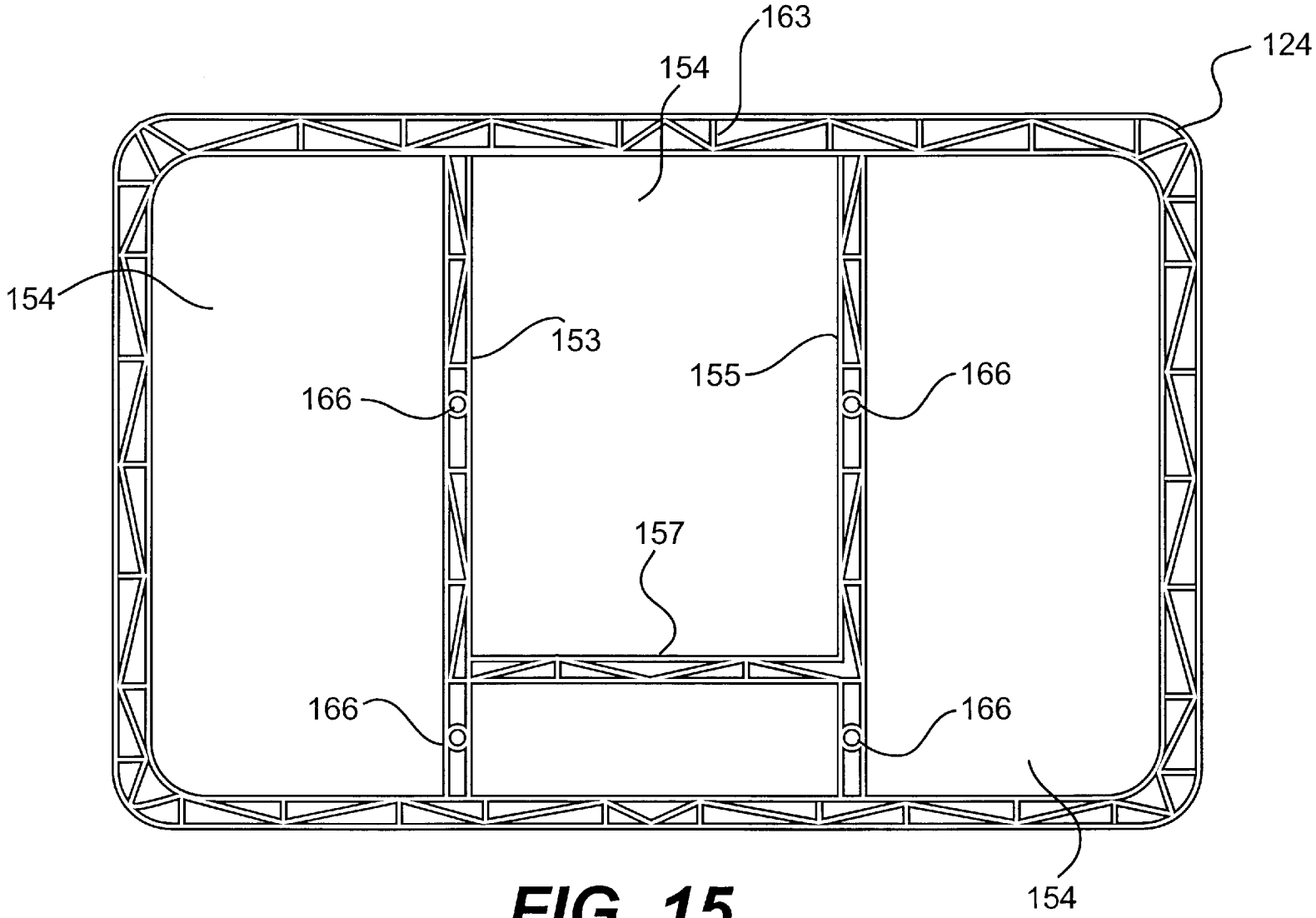
FIG. 15 is a rear plan view of a rear frame of the backboard shown in FIG. 14.

The rebound member 11 itself is illustrated in FIG. 4 as a substantially planar sheet or substrate and may have a range of thicknesses depending upon the particular rebounding characteristics desired as is well known in the art. In the particular embodiments described herein, the thickness preferably ranges from about 0.223 to about 0.250 inches. Rebound member 11 is preferably formed from a molded plastic, such as acrylic or polycarbonate. Acrylic is the preferred type of thermoplastic used in the invention and it may be clear or tinted; however, other planar substrates such as laminate, wood, aluminum or other extruded material, metal, and tempered glass also may be used. The front face 11*a* of the rebound member defines a rebound surface having sufficient rigidity when assembled in the frame members to rebound a basketball tossed against the backboard assembly 10. The rebound member has an outer peripheral edge 12. The rear face 11*b* of the rebound member abuts against the rear frame member when the rebound member is assembled within a recess 18 located in the rear frame 16, which is shown schematically in FIG. 12 described in detail below. Goal mounting holes 15 shown in FIG. 15 are formed in the substrate and are located toward the lower portion of the rebound member for receiving conventional basketball goal mounting bolts.

Figure 5:
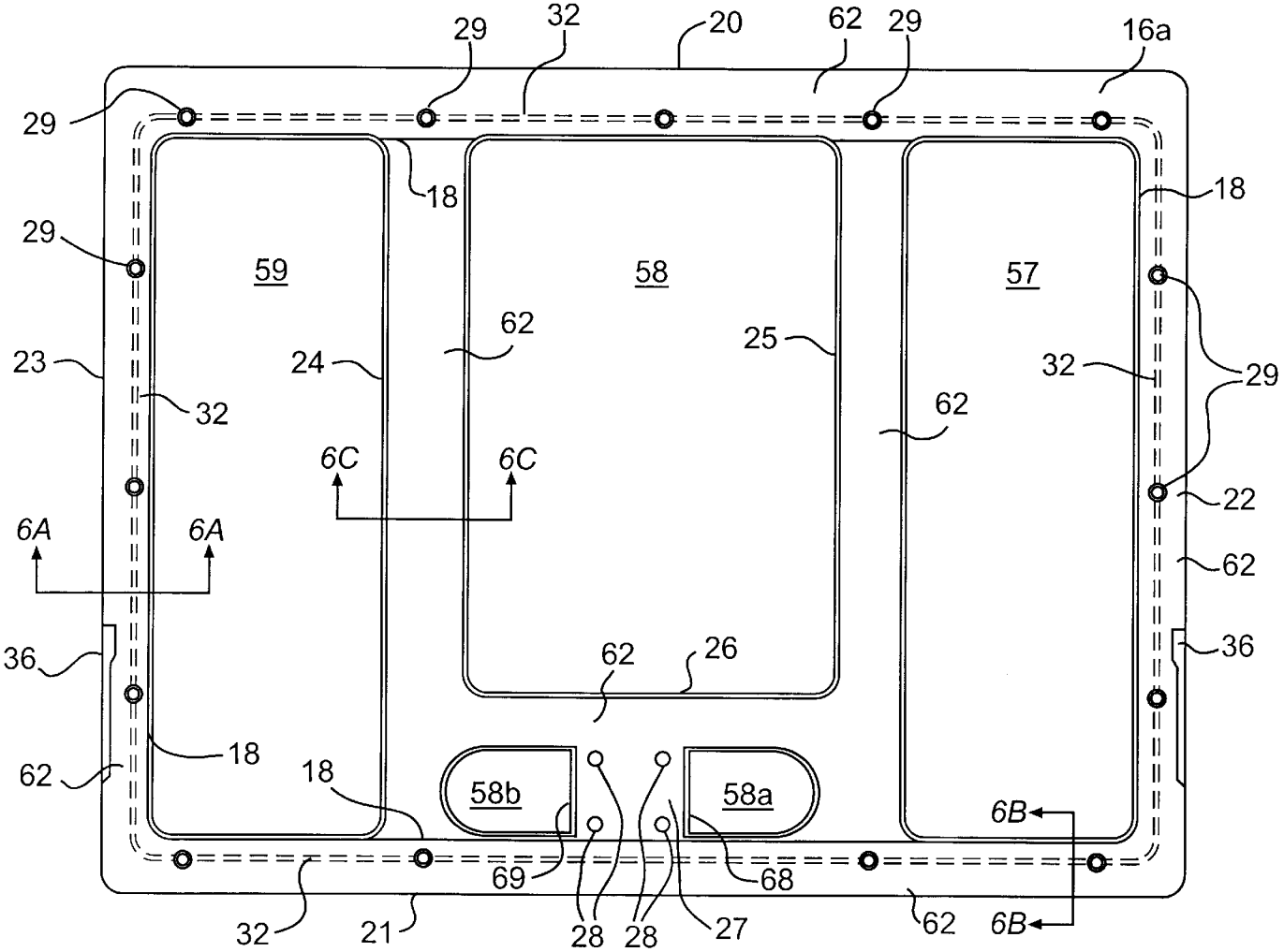
FIG. 5 is a front plan view of a rear frame shown in FIG. 3.

The front face 16*a* of rear frame 16 is shown in FIG. 5 in a simplified plan view for clarity. The rear frame 16 is formed as a relatively rigid, unitary piece of molded plastic which may be made by any known molding process including injection molding, compression molding, blow molding, roto-molding, resin transfer molding and reaction injection molding, for example. In addition, the plastic is preferably molded using one of these processes in combination with a strength-enhancing technique like structurally foaming the elastic, reinforcing it with fiberglass or the like, or using gas assist. The embodiments shown and described in FIGS. 3–13 are particularly suited for a backboard having a width within the approximate range of 40"–72" for which fiberglass-reinforced plastic made by injection molding in combination with structurally foaming the plastic is preferred. However, the rear frame can vary in size and thickness depending upon the rebound member employed and other types of molded plastic may be preferred for different designs. Use of these processes enables the rear frame to be molded in color plastic, which is resistant to fading or paint chipping as compared with painted steel frame assemblies.

Further, as a result of forming the frame 16 of the invention as a molded structure, it may be formed with different shapes (other than the generally rectangular shape shown) which could not have been conveniently provided by prior metal frames. For example, the frame 16 of the invention may have a cross-sectional or contour shape which varies around the periphery of the backboard 10 to give the backboard a desired visual appearance. It can easily include other ornamental features such as angled slots 49 provided on front frame 14. (See FIGS. 11A and 11B)

The generally rectangular perimeter of rear frame 16 is defined by upper portion 20, lower portion 21, and side portions 22 and 23, as illustrated in FIG. 5. Frame 16 also may include an interior support structure integrally molded with the perimeter members. The interior support structure includes interior transverse beams 24 and 25, interior horizontal beam 26 and goal mount support structure 27. Together the perimeter members and transverse beams form three large openings 57, 58, 59 and two smaller openings 58*a*, 58*b* in the rear frame. Goal mount support structure 27 is defined generally by side walls 68 and 69 and includes apertures 28 which are aligned with the holes 15 in the rebound member for mounting a basketball goal thereto in a conventional manner.

Figure 6A:
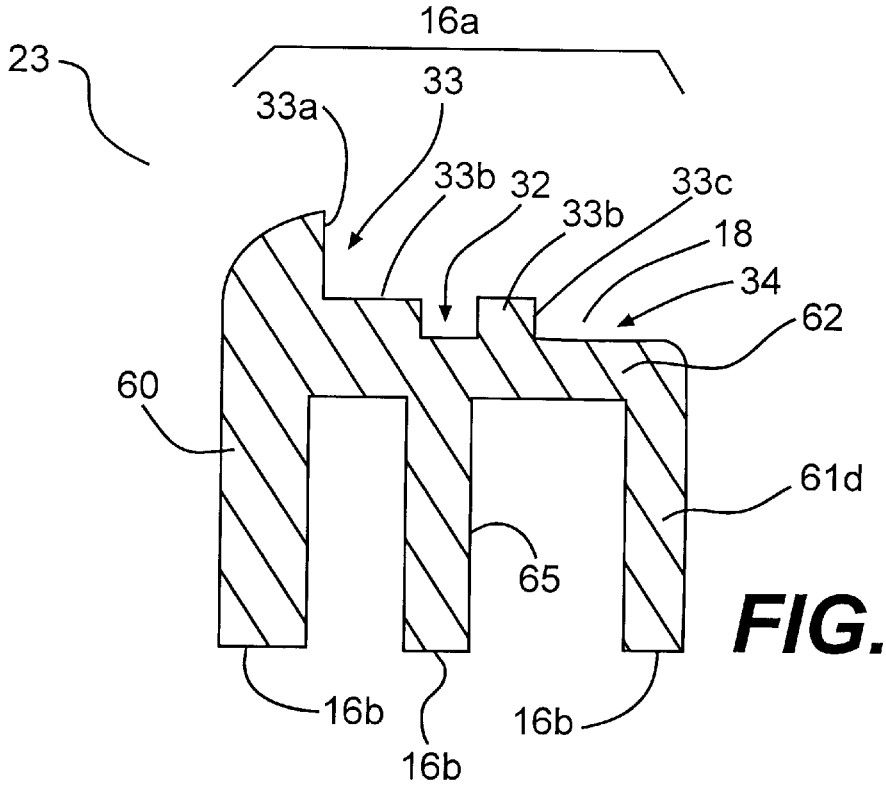
FIGS. 6A, 6B, and 6C are enlarged sectional views taken along corresponding lines in FIG. 5 illustrating various portions of the rear frame.
Figure 6B:
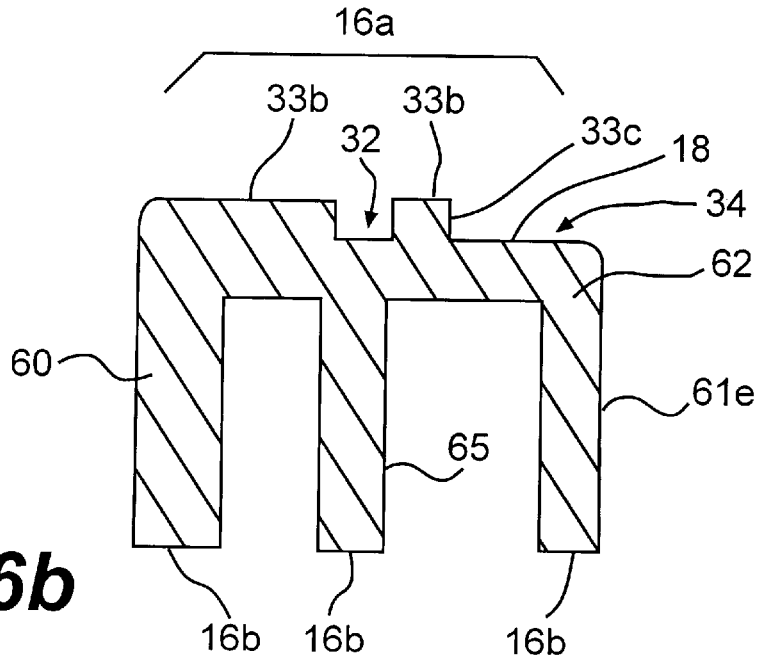
Figure 6C:
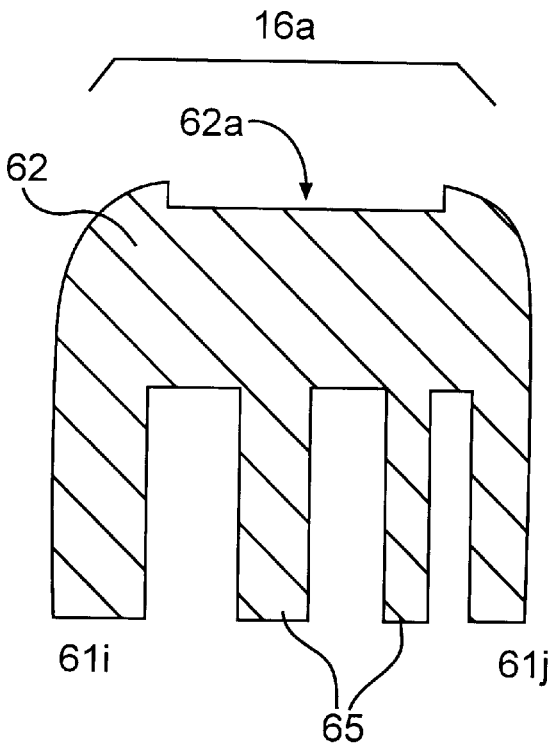
Figure 9:
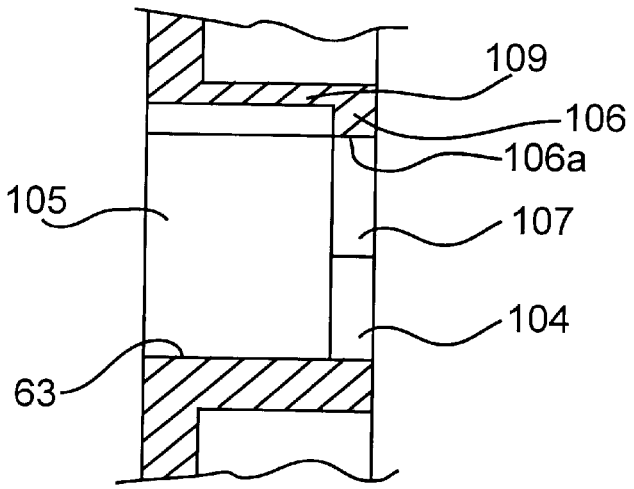
FIG. 9 is a sectional view taken along lines 9—9 of FIG. 7 illustrating one of the key hole mounting slots of the rear frame.

The structure of each perimeter rear frame portion 20–23 is shown best by viewing FIG. 5 in combination with FIGS. 6A, 6B, and 6C, which illustrate cross sectional views of side frame portion 23, lower frame portion 21 and transverse beam 24, respectively. Although FIG. 6A is directed to frame portion 23, the structure of side frame portion 22 and upper frame portion 20 is generally the same as that shown in FIG. 6A. Thus, frame portions 20, 22, and 23 each have a generally U-shape cross section defined by a bridging wall 62 and a pair of spaced walls 60 and 61 extending therefrom. Bridging wall 62 extends around the entire perimeter of rear frame 16 and defines at its upper surface the front face 16*a* of rear frame 16 as shown in FIG. 5. Bridging wall 62 includes a rounded edge portion having a shoulder formed by walls 33*a*, 33*b*, which define a recess 33. The recess 33 extends contiguously from a slotted portion 36 (discussed below) formed in the front face 16*a* of side frame portion 23 through upper frame portion 20, and side frame portion 22 until it terminates at slotted portion 36 formed in the front face 16*a* of the other side frame portion 22. Thus, recess 33 has three sides defined by the walls 33*a* in the upper and side frame portions 20 and 22, 23. FIG. 6B illustrates bottom portion 21 and the three-sided nature of recess 33, which is also apparent from FIG. 12. The front frame 14 is positioned within the recess when the front and rear frames are connected as shown schematically in FIG. 12.

FIG. 6A also shows a further groove 32 formed in wall 33*b* inwardly from recess 33. Groove 32 forms part of an alignment feature because it receives a projection extending from a rear surface of front frame 14 (such as ridge 48 shown in FIGS. 11A and 11B) as the front and rear frames are assembled together. Unlike recess 33, groove 32 is formed contiguously around the perimeter of all of the rear frame portions 20–23 as schematically shown in FIG. 5.

Referring again to FIG. 6A another groove 34 is formed in bottom wall 33*b* inwardly from groove 32. Groove 34 is limited by wall 33*c* and is formed in each of the perimeter frame portions 20–23 to define the recess 18 in the front face 16*a* of the rear frame, which receives the rebound member 11 (shown best in FIG. 12). The peripheral edge 12 of the rebound member is located adjacent surrounding wall 33*c* forming the four-sided recess 18.

FIG. 6A also shows a longitudinally extending reinforcing rib 65 disposed between walls 60 and 61. One or more ribs 65 may be provided in each of the rear frame portions as an integral part of a rear frame reinforcement structure, which is described in more detail below.

As shown in FIG. 6C, transverse beam 24 also may have a U-shaped cross section defined by a bridging wall 62 and a pair of spaced walls 61*i* and 61*j* depending downwardly therefrom. Transverse beam 25 preferably has the same structure as that shown in FIG. 6C. Note that FIG. 6C illustrates an alternative embodiment of providing two inner ribs 65 instead of one as shown in FIGS. 6A and 6B; however, the actual number of such ribs provided is obviously a design choice.

When placed in recess 18, rebound member 11 rests on wall 62 of transverse beams 24 and 25, which may be formed with a shallow, longitudinally extending recess 62*a* adapted to receive a padding material, such as foamed inserts. The padding may be provided in any combination of interior beams or perimeter frame members to eliminate spaces between the rebound member and the supporting frame, thereby decreasing lateral movement of the rebound member, increasing its rigidity and improving performance.

Figure 7:
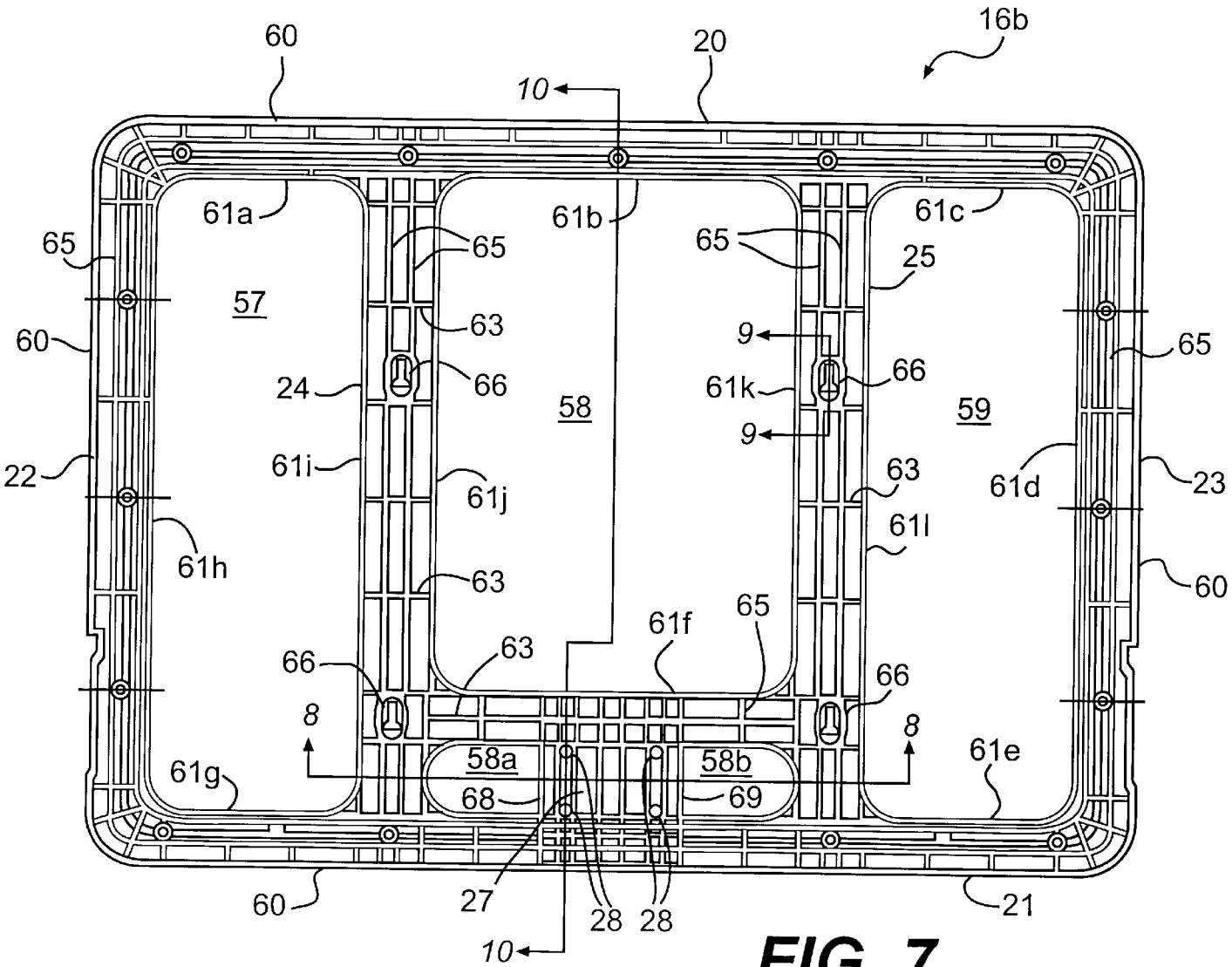
FIG. 7 is a rear plan view of the rear frame illustrated in FIGS. 5–6.
Figure 8:
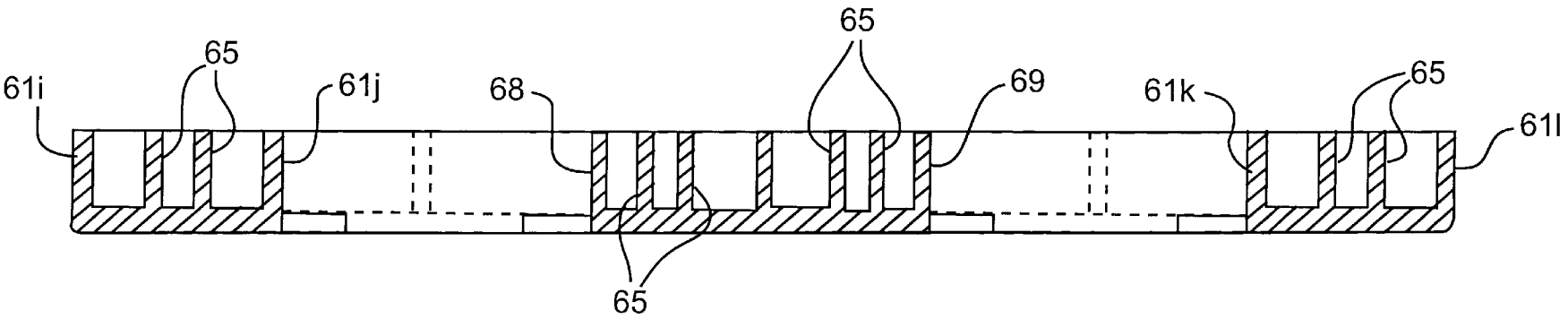
FIG. 8 is a sectional view taken along lines 8—8 of FIG. 7 illustrating the transverse beams and a portion of the reinforcement rib structure of the rear frame.

FIG. 7 illustrates the posterior surface 16*b* of rear frame 16 and more clearly shows the molded construction of frame portions 20–23 as well as one possible rib configuration (in phantom) In addition to the rib structure 65, which extends longitudinally in each of the rear frame portions 20–25, FIG. 7 shows a plurality of lateral ribs 63 integrally molded with longitudinal ribs 65. The lateral ribs extend perpendicularly across the longitudinal ribs and are integrally formed therewith as part of rear frame 16. The goal mount portion 27 also includes this type of rib structure, as shown in FIGS. 7–8. Alternative reinforcing structures or means may be employed to reinforce the frame. However, it is preferable that the reinforcing structure be integrally molded with the perimeter and interior frame members.

The large spaces 57, 58, and 59 formed between the frame members are defined by the various wall portions of the perimeter and internal beam portions shown in FIGS. 6A–6C. In particular, FIG. 7 shows space 57 being defined by inner walls 61*a*, 61*i*, 61*g* and 61*h*; space 58 being defined by inner walls 61*b*, 61*d*, 61*f*, and 61*j*, and space 59 being defined by inner walls 61*c*, 61*d*, 61*e* and 61*l*.

Figure 13:
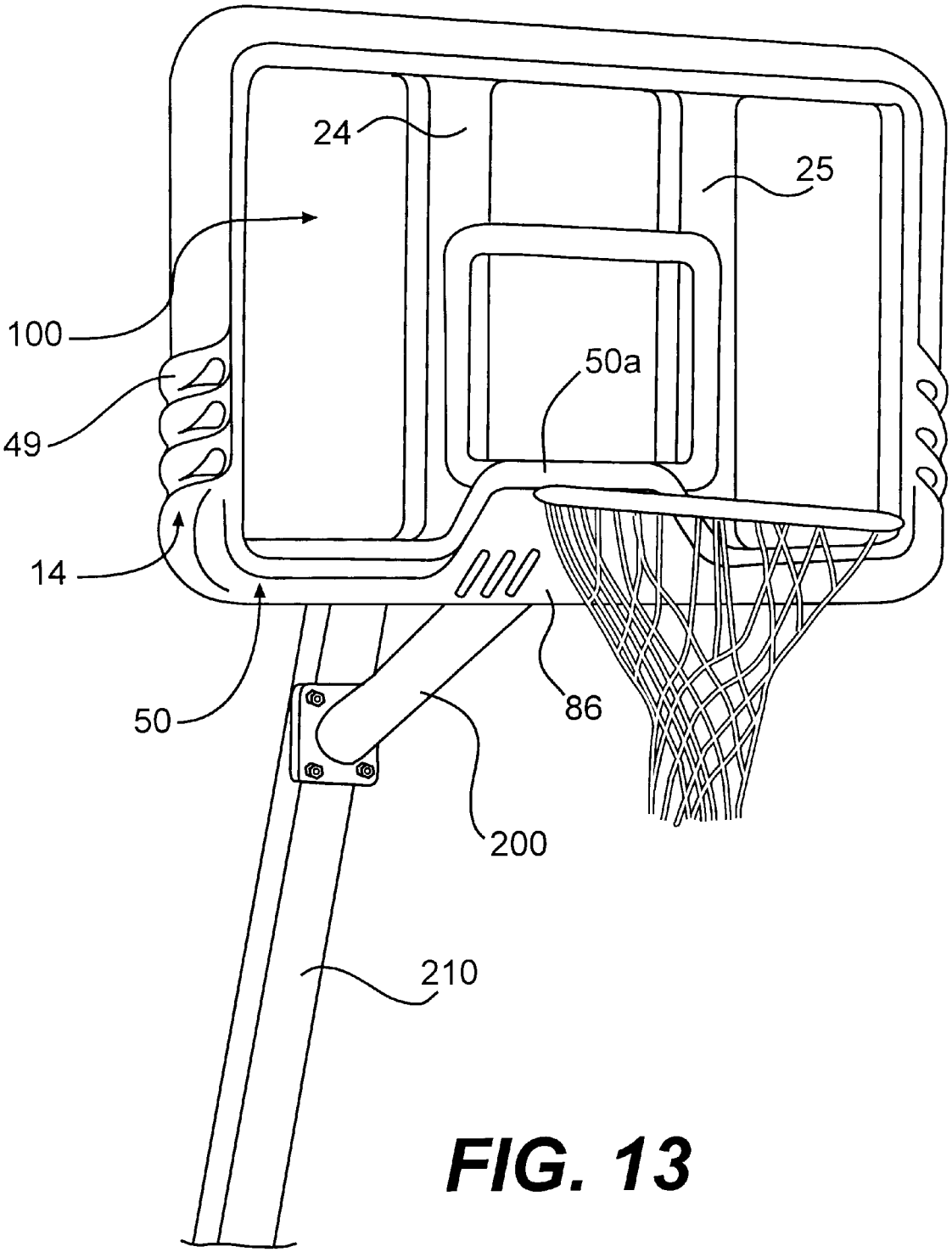
FIG. 13 is a perspective view illustrating a second embodiment of a molded frame backboard of the invention.

Rear frame 16 also includes slots 66 located within transverse beams 24 and 25, which preferably are formed as key way slots that cooperate with bolts for attaching the backboard assembly to a support structure. The key way slots are integrally molded between longitudinal ribs 65 and are adapted to receive and retain the head of a carriage bolt or similar fastener to be connected in a manner known in the art to a support such as an extension arm, or elevator for supporting the backboard on a pole, or similar structure. (One example of such a support structure is shown in FIG. 13.) As can be seen with reference to FIGS. 7 and 9, key way slots 66 are defined by a large opening 104 and an extending slot 107 formed in an oval shaped front wall 106 of a cavity 105. The cavity has a predetermined length less than the length of transverse beam 25. The bottom of the cavity is defined by rib 63 and the top is defined by another wall 109, integrally molded with front wall 106 and the rib structure. To attach the backboard assembly to a support, the head of the supporting, carriage bolt is placed into large opening 106. As the backboard moves downwardly relative to the bolt, the bolt is retained within cavity 105. The backboard comes to rest when the bolt abuts the bottom portion 106*a* of wall 106, which defines the top of slot 107. The backboard is thus held in place while the bolt is tightened by a suitable nut in a conventional manner.

Figure 10:
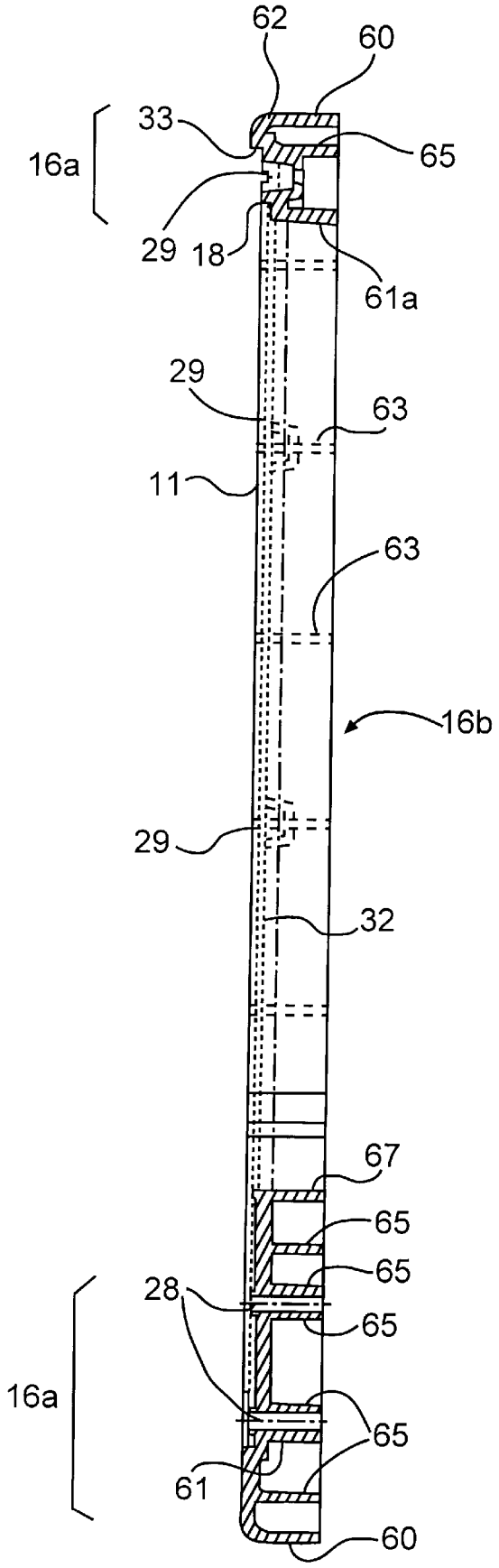
FIG. 10 is a sectional view taken along lines 10—10 of FIG. 7 illustrating a recess in the rear frame for receiving the rebound member.

FIG. 10 is a sectional view through the middle of rear frame 16 illustrating the recess 33 for the front frame 14 and the recess 18 which locates the rebound member within rear frame 16. It also shows one of a plurality of bores 29 disposed around the frame members 20–23. Bores 29 extend from the bridging wall 62 for receiving bosses 47, which aids in locating the front frame in a predetermined position relative to the rear frame. The boxes 29 are also adapted to receive a fastener member such as a self-tapping screw for attaching the front and rear frames together. However, it should be apparent that any conventional fastening technique known in the art to lock the frames together, including molded snaps and commercially available push-in fasteners may be used instead of this particular fastening structure. An example of a mold snap structure is described in the embodiment of FIGS. 16–23 below.

Figure 11A:
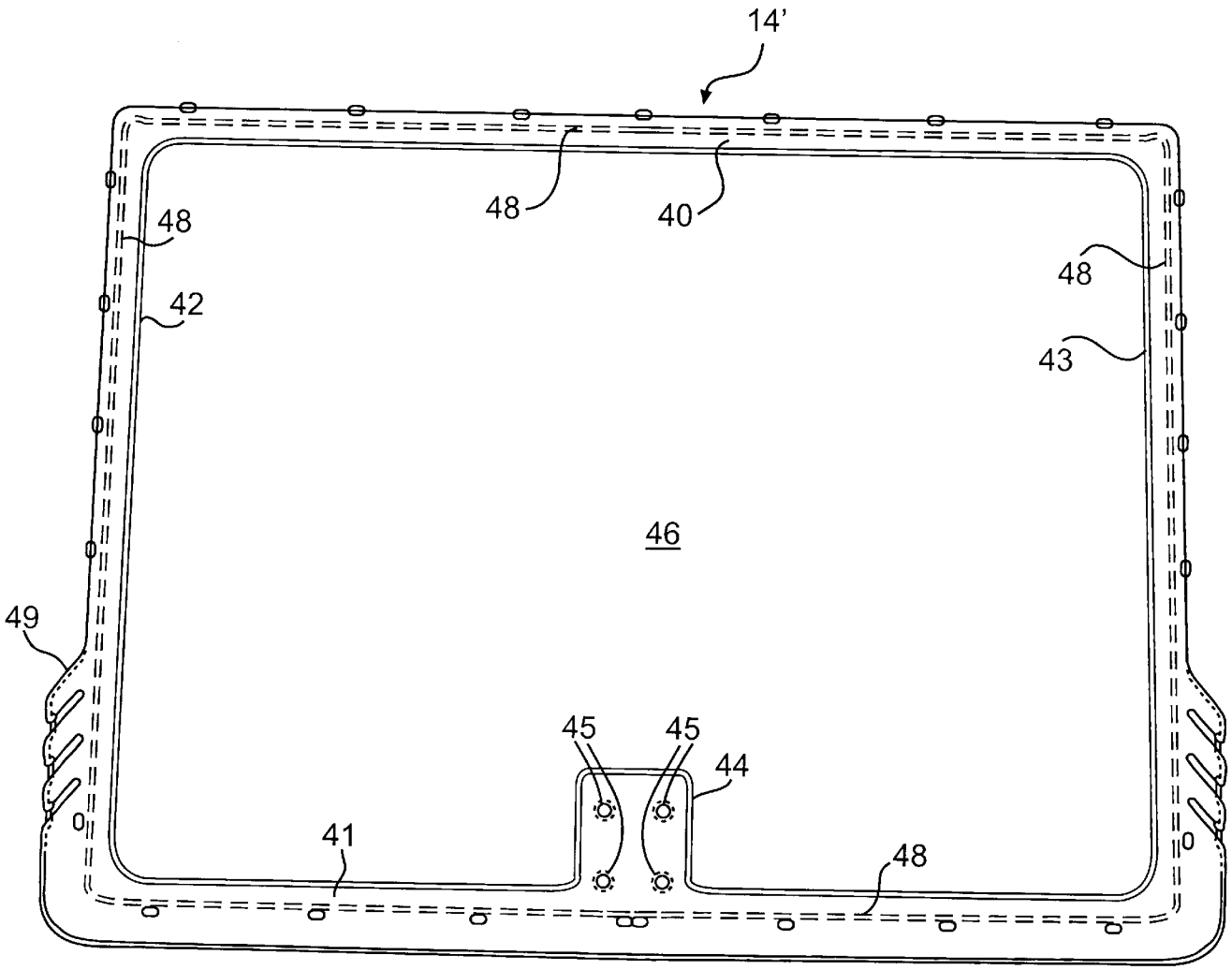
Figure 11B:
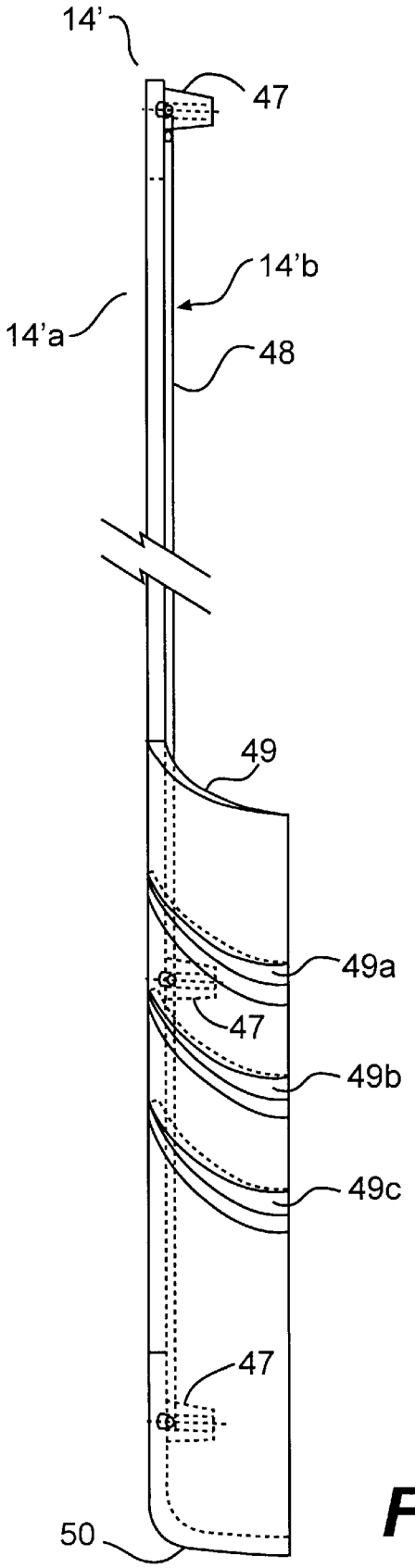
FIG. 11B is a partial, side view of the front frame.

FIG. 11A illustrates an actual configuration 14– of the front frame 14 schematically shown in FIG. 3. Front frame 14– is a unitary molded piece of plastic in the form of a trim ring having a generally rectangular perimeter defined by upper member 40, lower member 41, and side members 42 and 43, which together define a large central opening 46 therebetween. Central opening 46 provides substantially unobstructed access to the rebound surface 11*a* of the rebound member. Lower beam 41 is molded to include a carved flange portion 50 shown schematically in FIG. 12. A goal mounting shield 44 extends upwardly from beam 41 and includes bores 45 which are aligned with bores 15 of rebound member 11 and goal mount apertures 28 of rear frame 16 when the front frame is connected to the rear frame. Shield 44 serves to protect the front surface of rebound member 11 when a basketball goal is mounted to backboard assembly 10. Front trim ring 14' is positioned on top of rear frame 16 such that front trim ring members 40, 41, 42 and 43 cooperate with rear frame members 20, 21, 22, and 23, respectively. As shown in FIG. 11B, the alignment ridge 48 projects outwardly from the rear surface 14*b'* of front trim ring 14' and extends around the perimeter of rear surface of the front frame 14' (shown in phantom with reference to FIG. 11A). The ridge 48 also interconnects the bosses 47, which also project outwardly from the rear surface 14*b'* of the trim ring 14' in a pattern that matches the spacing of bores 29 of rear frame 16. Flange 50 includes curved side portions 49, which extend laterally from side portions 42 and 43 and longitudinally down side portions 42 and 43. The side portions 49 of the flange 50 are adapted to extend around rear frame sides 22 and 23. Each side portion 49 may have projections one or more 49*a*, 49*b*, 49*c*, which are received within notched portion 36 of sides 22, 23. This engagement is shown best in FIG. 13, discussed below.

Figure 12:
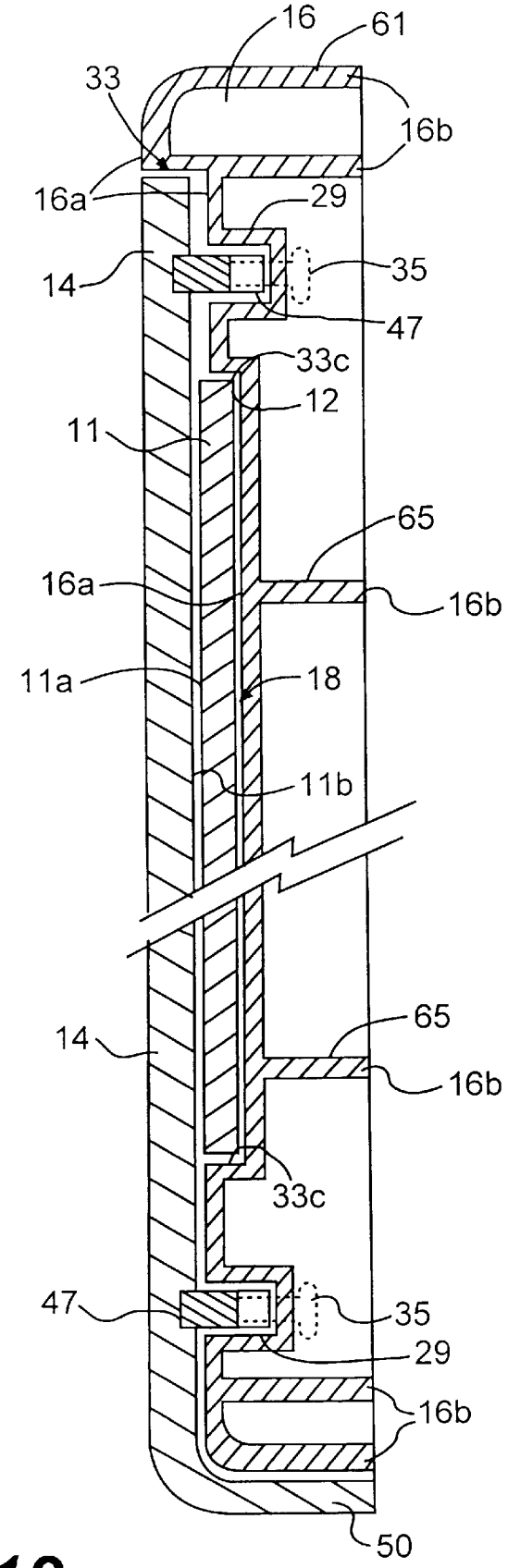
FIG. 12 is a partial sectional view schematically illustrating how the rebound member is supported between the rear and front frames of the invention, as well as two of the fasteners connecting the frames together.

FIG. 12 schematically shows the rebound member 11 located in recess 18 sandwiched between front frame 14 and rear frame 16. Front trim ring 14 covers the outer periphery of the rebound surface 11*a* of the rebound member 11 in this position and central opening 46 exposes the central portion of the rebound surface 11*a*. As noted above, the frame members are aligned by the bore and boss structure and the groove 32, which accepts ridge 48 (which are not visible in FIG. 12) as the front frame and rear frame are joined to facilitate assembly. The frames are attached together by a fastening structure, such as a self-tapping screws 35 extending through the cooperating bores 29 and bosses 47, for example. After connection, as a basketball is tossed against rebound surface 11*a*, the interior beam structure in combination with the perimeter frame members, rib structure and padding, if provided, act to brace the rebound member and provide sufficient rigidity to deflect the thrown ball.

Encapsulation of the rebound member in the above-described manner reduces the likelihood of significant cracking developing in the rebound member because its peripheral edge 12 is not exposed. If cracking does occur, it is unlikely that any pieces would fall out of the frame.

Although it should be apparent from the description above, backboards of the invention may be made advantageously as follows. After the parts are molded as discussed above, the rebound member is placed in the recess 18 formed in the rear frame, for instance, by dropping it in place. If padding is used, it is placed in one or more of the shallow recesses 62*a* of the rear frame prior to this step. The front frame is then presented to the rear frame and aligned therewith as the ridge 48 of the front frame is received in the groove 32 in the rear frame and the bosses 47 are received in the bores 47. Thus, the front frame also may be dropped in place on top of the rear frame and rebound member. The front frame then abuts against the rear frame and the outer periphery of the rebound member. The front frame is then attached to the rear frame by way of the fasteners 35, or other suitable structure as discussed above, and the rebound surface of the rebound member is exposed through the central opening in the front frame.

FIG. 13 shows an alternative embodiment of the invention, which enables the use of a rebound member without any mounting holes formed therein for attaching the goal to the backboard. This is accomplished by the same type of structure described above, with the following differences. The rebound member 100' and front frame 14" are molded, such as in the illustrated curved shape at front frame portion 50*a*, to extend upwardly above the goal mount section 86 in the rear frame 28. In this manner, a goal may be attached directly to the rear frame structure while obviating the need for mounting holes in the rebound member or front frame. FIG. 13 also illustrates a typical backboard support mechanism including an extension arm 210, which is attached to the backboard using mounting bolts extending in key way slots formed in the back of transverse beams 24, 25, as discussed above. The extension arm is provided for mounting the backboard on an angled support pole 210 of a portable basketball support system. Obviously, any other type of backboard support mechanism known in the art may be employed for supporting the backboards of the invention. An example of a portable basketball support system that may be used with the backboards of the invention, which is particularly advantageous for larger backboards, is disclosed in the assignee's copending application, entitled Portable Basketball Support System with Separate Ballast Tank, filed simultaneously herewith.

Figure 14:
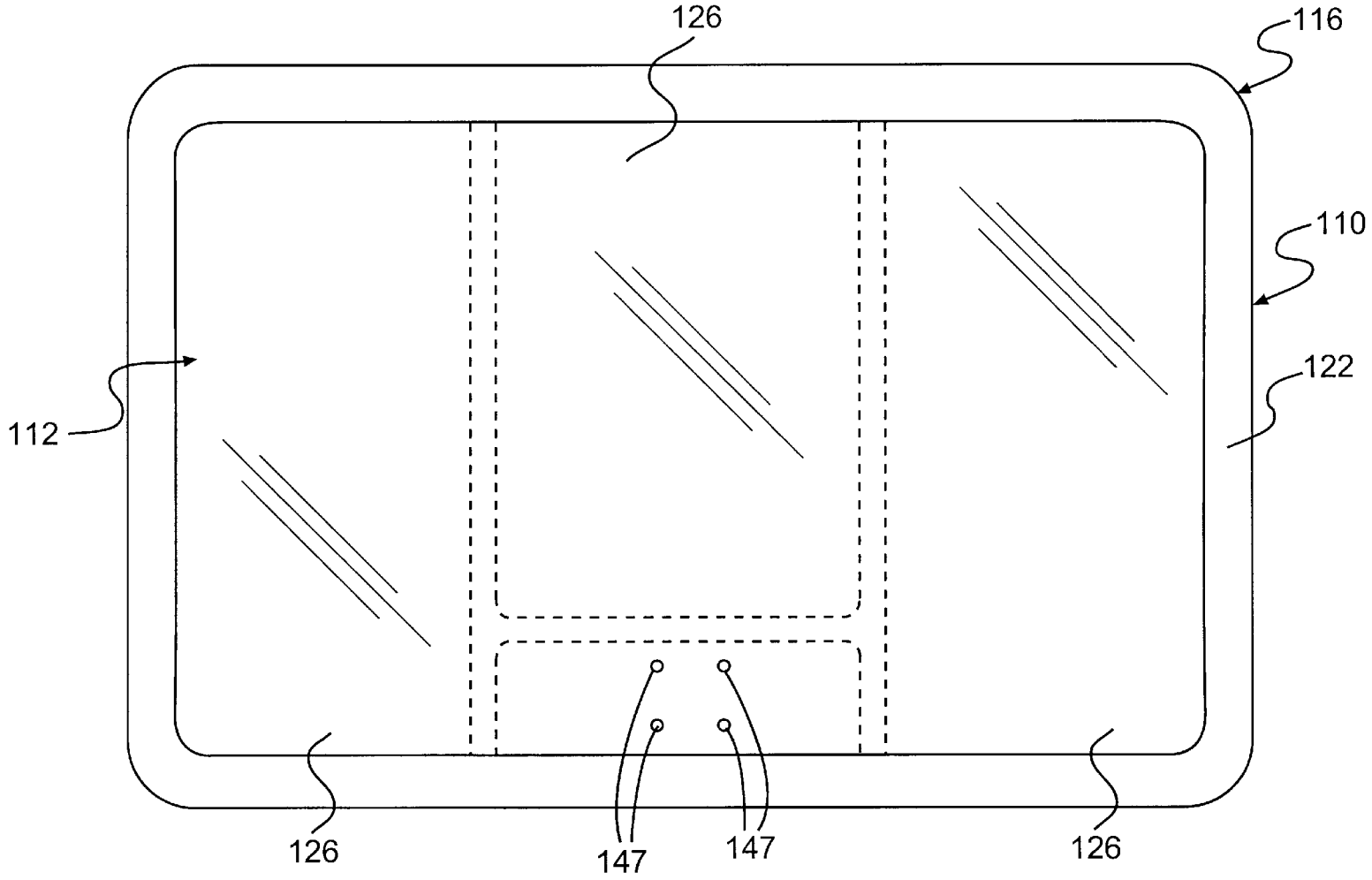
FIG. 14 is a front plan view of a third embodiment of a backboard of the invention.

Referring to FIGS. 14 and 15, a third embodiment of the invention is shown and designated by reference numeral 110. Similar to the first and second embodiments, backboard 110 includes a front frame 122 and rear frame 124 wherein the front and rear frames 122, 124 support a rebound member 112 and define substantially open central areas 126, 154 such that front and rear surfaces of the rebound member 112 are substantially unobstructed.

As shown in FIG. 15, the rear frame member 124 is provided with an interior support structure similar to that illustrated in the first and second embodiments. The support structure includes a pair of transverse support beams 153, 155 and a horizontal support beam 157 extending between the transverse beams 153, 155. The transverse beams 153, 155 include apertures 164, which may be threaded for receiving mounting bolts to mount the backboard 110 to a support structure, or in the form of key slots such as shown and described in FIGS. 7 and 9 above. An integrally molded reinforcing rib structure also may be provided, such as rib supports 163 and diagonally extending supports 164, which strengthen the rear frame 124.

It should be noted that in this particular embodiment, the frame 116 does not include a goal support portion as in the previous embodiments. Instead, the goal for the basketball backboard is mounted directly to the rebound member 112 at apertures 147 formed in the rebound member 112. As in the previous embodiments, the front and rear frames 122, 124 may be formed as separately molded plastic members adapted to engage each other to firmly support the rebound member 112 by any conventional fastening structure including self-tapping screws, molded snaps, and push-in fasteners.

Figure 16:
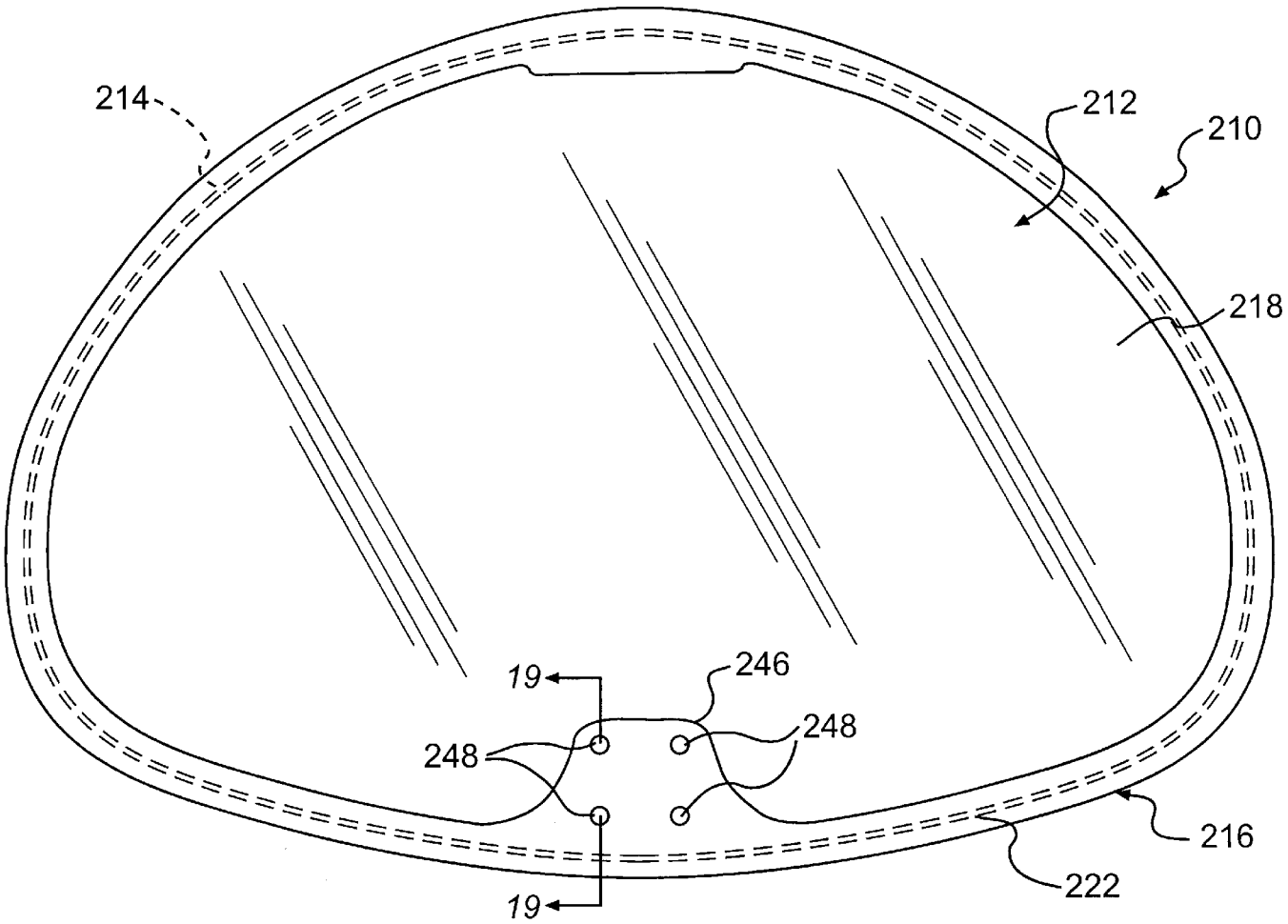
FIG. 16 is a front view of a backboard illustrating a fourth embodiment of the invention.

Referring to FIG. 16, a fourth embodiment of the invention is illustrated in the form of a fan-shaped backboard 210 and includes a substantially planar rebound member 212 defining a peripheral edge 214, and a molded frame 216 extending around the peripheral edge 214. The rebound member 212 includes a front face 218 and a rear face 220 (FIG. 22) wherein the front face 218 forms a planar rebound surface for the backboard 10. In this embodiment, the rebound member 12 is preferably approximately 0.25 inches thick and formed of clear or tinted acrylic or a polycarbonate material.

Figure 17:
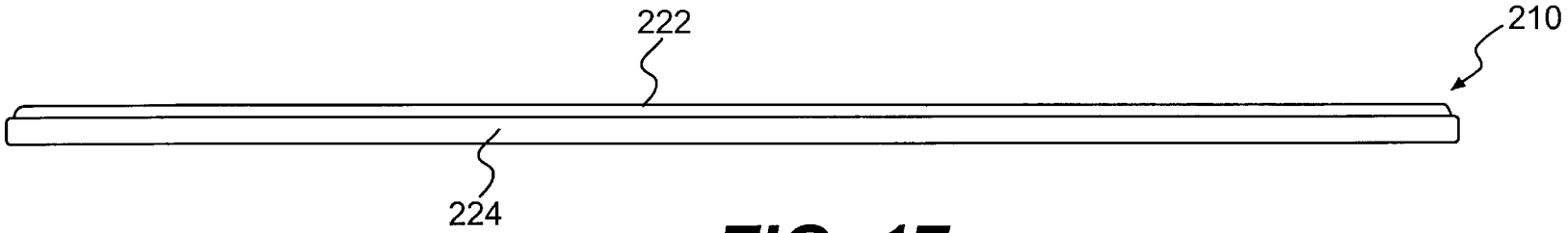
FIG. 17 is a bottom edge view of the backboard shown in FIG. 16.
Figure 18:
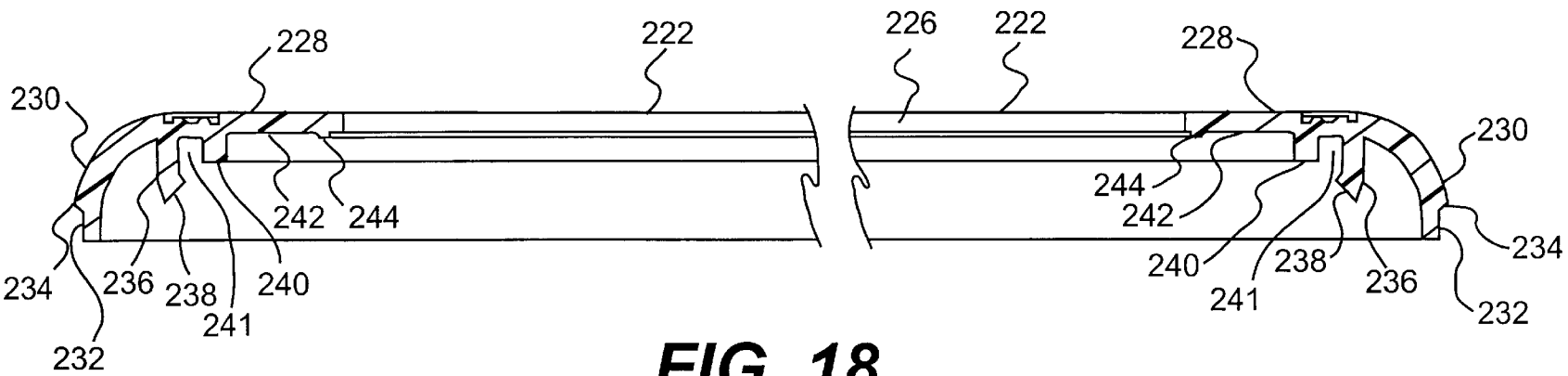
FIG. 18 is a side elevational cross-sectional view of a front frame for the backboard shown in FIG. 16.

Referring to FIG. 17, the frame 216 includes a front frame 222 and a rear frame 224 which are joined or coupled to each other to support the rebound member 212. As seen in FIG. 18, the front frame 222 is formed as a ring-like annular structure with a substantially open central area 226 such that the front face 218 of the rebound member 212 is substantially unobstructed by the front frame 222. The front frame includes a front portion 228 and a side portion 230 extending substantially perpendicular to the front portion 228. The side portion 230 includes a rearwardly extending rim 232 located adjacent to a shoulder area 234. A plurality of snaps in the form of fastener or tongue members 236 extend rearwardly from the front portion 228 at locations radially inwardly from the side portion 230. The tongue members 236 are positioned at spaced locations along the front portion 228 and include a detent end 238 for engagement with the rear frame 224, as will be described further below.

An abutment flange 240 extends around the front frame 224 radially inwardly from the tongue members 236 for abutting the peripheral edge 214 of the rebound member 212, and a groove 241 is defined between the abutment flange 240 and the tongues 236. In addition, a gripping area 242 is defined radially inwardly from the abutment flange 240 and includes a flange 244 for engaging the front face 218 of the rebound member 212 in gripping engagement.

Figure 19:
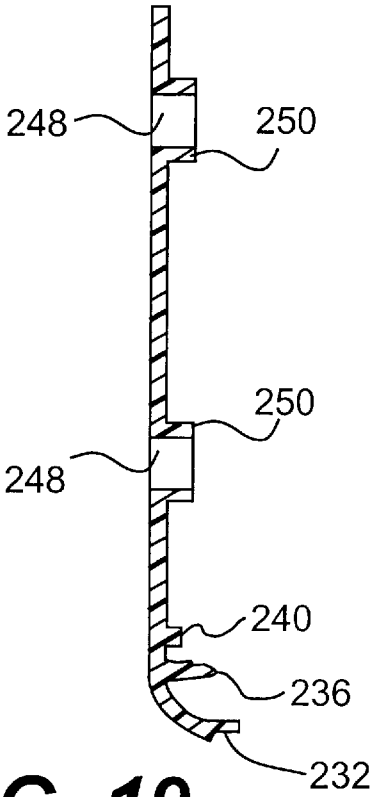
FIG. 19 is a cross-sectional view taken along line 4—4 in FIG. 16.

Referring to FIGS. 16 and 19 in combination, the front frame 222 further includes a goal support portion 246 extending radially inwardly from a lower portion of the front frame 222 similar to that disclosed in the previous embodiments of the inventions. The goal support portion 246 includes apertures 248 for receiving goal mounting bolts, and is further provided with rearwardly extending reinforcing sleeves 250.

Figure 20:
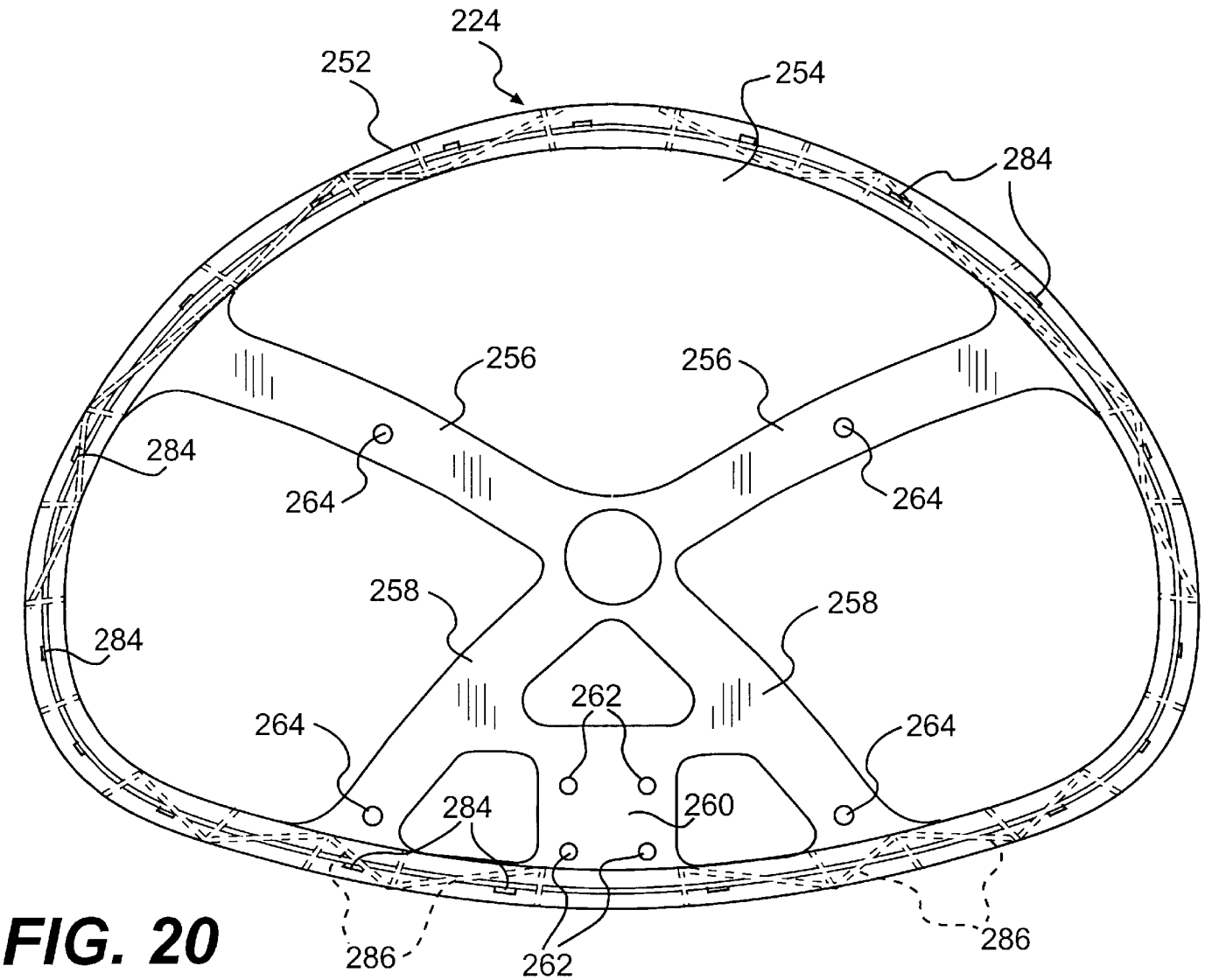
FIG. 20 is a front plan view of a rear frame of the backboard shown in FIG. 16.
Figure 21:
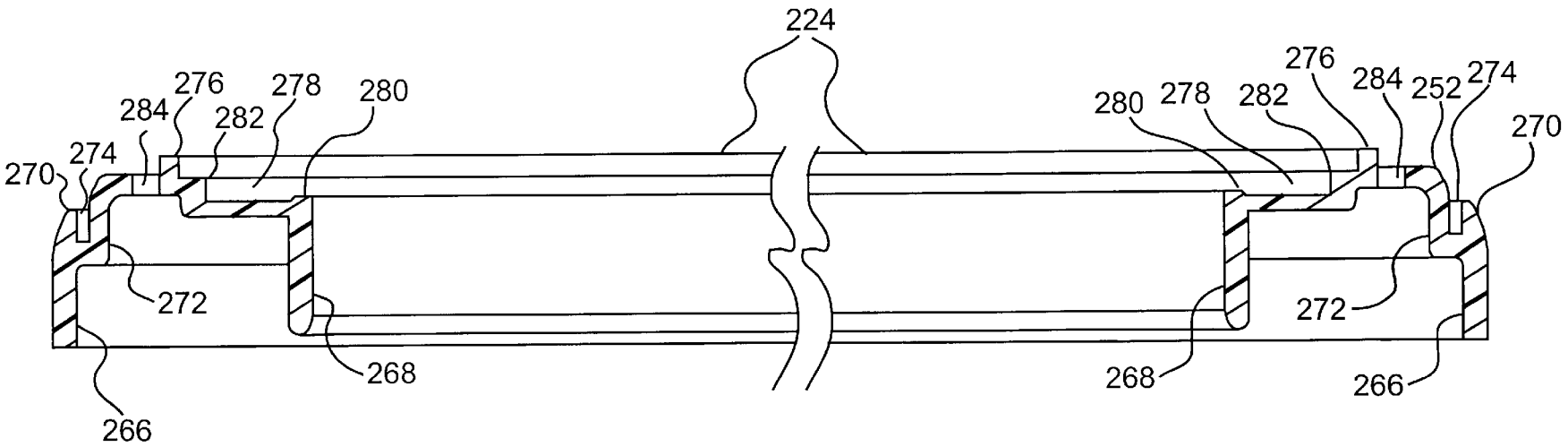
FIG. 21 is a side elevational cross-sectional view of the rear frame shown in FIG. 20.

Referring to FIGS. 20 and 21, the rear frame 224 comprises a ring-like or annular member 252 surrounding a substantially open central area 254. A pair of integrally molded, upper support beams 256 extend radially inwardly from an upper portion of the member 252 toward a central portion of the open area 254 and are formed integrally with a pair of lower support beams 258 extending from a lower portion of the member 252 radially inwardly into the open area 254. In addition, a goal support portion 260 extends from the lower portion of the annular member 252 and is formed integrally with the lower beams 258. The goal support portion 260 is formed with apertures 262, which are aligned with the apertures 248 in the goal support portion 246 of the front frame 222 for receiving support bolts to support a basketball goal on the backboard assembly 210 of the invention. Further, mounting holes 264 are formed in the upper and lower beams 256, 258 for receiving bolts to mount the backboard 210 to a support structure, such as a support post. These holes may also be in the form of key way slots as discussed above.

As shown in FIG. 20, a plurality of apertures 284 are defined in the annular member 252. The apertures 284 are located adjacent to and radially outwardly from the forwardly extending flange 276, and are adapted to receive the tongue members 236, as is described further below. In addition, a plurality of reinforcing or strengthening ribs 286 are provided along the rim portion 252 and support beams 256, 258 to further strengthen the rear frame member 224.

As shown in FIG. 21, the annular member 252 of the rear frame 224 has a generally U-shaped, cross-section and includes a radially outer leg 266 and a radially inner leg 268 extending parallel to each other around the annular member 252. The outer leg 266 includes a forwardly extending rim 270 located in spaced relation to a rearwardly extending flange 272 to define a groove 274 therebetween. In addition, a flange 276 extends forwardly from the annular member 252, and a rear gripping area 278 is defined radially inwardly from the forwardly extending flange 276. The rear gripping area 278 includes a flange 280 for facilitating gripping engagement of the rear face 220 of the rebound element 212. Further, the gripping area 278 is located radially inwardly from an edge 282 for abutting the peripheral edge 214 of the rebound member 212.

Figure 22:
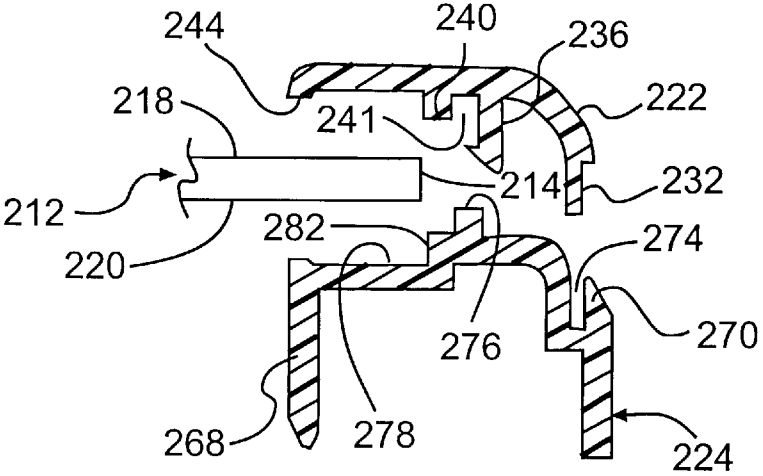
FIG. 22 is a side elevational cross-sectional view of the cooperating portions of the front and rear frame of the fourth embodiment of the invention prior to assembly.
Figure 23:
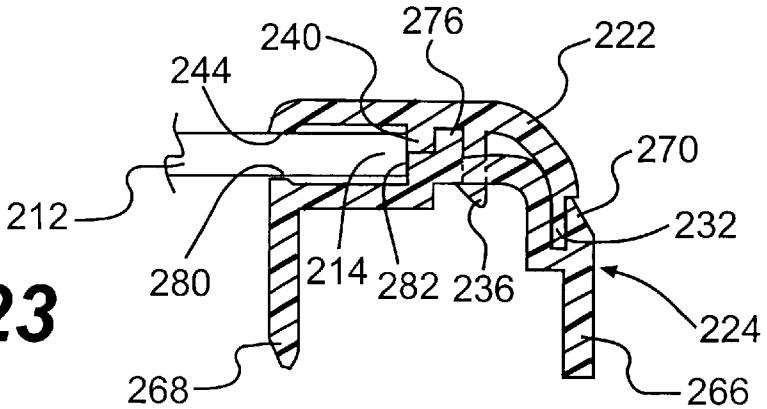
FIG. 23 is a side elevational cross-sectional view showing the front and rear frame of the fourth embodiment in gripping engagement with a rebound member.

Referring to FIGS. 22 and 23, the assembly of the backboard 210 is illustrated. Initially, the rebound member 212 is placed in the gripping area 278 of the rear frame 224 such that the peripheral edge 214 rests against the abutment edge 282 and the rear surface 220 engages the gripping flange 280. The upper frame 222 is then moved into engagement with the lower frame 224 as well as into engagement with the front surface 218 of the rebound member 212. Specifically, the rim 232 of the front frame 222 is located within the groove 274 of the rear frame 224, and the forwardly extending flange 276 of the rear frame 224 is located within the groove 241 of the front frame 222. In addition, the tongue members 236 are molded snaps that are engaged within respective apertures 284 such that the detents 238 lock the front frame 222 to the rear frame 224. It should be noted that an adhesive may be provided in addition to or in place of the tongue members 236 and apertures 284 to hold the front and rear frame sections 222, 224 in engagement with each other.

In this position, the peripheral edge 214 of the rebound member 212 is located in engagement with the abutment flange 244 as well as with the abutment edge 282. In addition, the gripping flanges 244 and 280 are positioned opposing each other in engagement with the front and rear faces 218 and 220, respectively, of the rebound member 212. It should be noted that the construction of the gripping areas 242, 278 allows a limited amount of resilient flexure of the front and rear frame member 222, 224 in the area of engagement with the rebound member 212. Thus, the frame 216 compensates for tolerance variations in the thickness of the rebound member 212 and is in substantially continuous engagement with the area adjacent to the peripheral edge 214. The continuous engagement provided by the frame 216 ensures that a substantially continuous support is provided for the rebound member 212 whereby cracking and other stress related damage to the rebound member 212 is minimized.

In addition, the construction of the frame of the invention enables the backboard to be assembled with the components for the backboard placed in stacked relation to each other, as described above with reference to FIGS. 12, 20 and 21. As noted previously, this assembly method provide,, certain advantages over that associated with prior art basketball structures incorporating an extruded frame member wherein assembly of the prior structure is performed by wrapping the frame around the edge of the backboard.

What is claimed is:

1. A basketball backboard assembly comprising:

a rebound member having a rebound surface, a peripheral edge extending about the periphery of said rebound member, and an interior portion disposed w thin the periphery;

a molded plastic frame, said frame comprising a unitary molded plastic front frame member and a unitary molded plastic rear frame member, the rear frame member cooperating with the front frame member to support said rebound member, wherein said molded plastic frame comprises at least one interior support beam; and wherein said rebound member is disposed between said front and rear frame members and substantially said peripheral edge is retained between said front and rear frame members, and wherein said interior support beam supports at least part of the interior portion of said rebound member.

2. The basketball backboard assembly of claim 1 wherein said front and rear frame members are detachably connected to each other.

3. The basketball backboard assembly of claim 2 further comprising at least one fastening structure extending between said front and rear frame members.

4. The basketball backboard assembly of claim 3 wherein said at least one fastening structure includes a molded snap and recess, said snap being molded within one of said front frame and a rear frame, said recess being integrally formed in the other of said front and rear frame.

5. The basketball backboard assembly of claim 3 wherein said at least one fastening structure comprises at least one threaded member received in at least one corresponding aperture extending between said front and rear frame members.

6. The basketball backboard assembly of claim 1 wherein at least one of said front and rear frame members has a flange portion extending beyond said peripheral edge.

7. The basketball backboard assembly of claim 1 wherein said rebound m ember has front and rear faces, said rebound surface being defined on said front face, a portion of said front face being disposed against said front frame member and a portion of said rear face being disposed against said rear frame member.

8. The basketball backboard assembly of claim 1 further comprising means for engaging said front and rear frame members together to retain at least a portion of said peripheral edge of said rebound member within one of said frame members.

9. The basketball backboard assembly of claim 1 wherein said rebound member comprises a substantially planar sheet of material having a peripheral edge and including a front face and a rear face, said rebound surface being disposed on a portion of said front face, and said peripheral edge being disposed substantially within at least one of said frame members.

10. The basketball backboard assembly of claim 9 wherein said sheet of material is formed from at least one material selected from the group consisting of moldable plastic, wood, laminate, tempered glass and metal.

11. The basketball backboard assembly of claim 10 wherein said moldable plastic includes at least one material selected from the group consisting of acrylic and polycarbonate.

12. The basketball backboard assembly of claim 1 wherein said front frame member is formed of moldable plastic material having an unobstructed open central area providing substantial access to said rebound surface.

13. The basketball backboard assembly of claim 1 wherein said rear frame member is formed of at least one moldable material selected from the group consisting essentially of injection molded plastic, structurally foamed plastic, fiberglass reinforced plastic, and plastic made with gas assist.

14. The basketball backboard assembly of claim 13 wherein said rear frame member includes an outer periphery and an inner reinforcing structure integrally formed with said outer periphery.

15. The basketball backboard assembly of claim 14 wherein said outer periphery comprises a channel member surrounding said inner reinforcing structure with at least one of said channel member and said reinforcing structure including strengthening ribs.

16. The basketball backboard assembly of claim 1 further comprising padding material disposed between said rebound member and said rear frame to reduce spaces between said rebound member and said rear frame.

17. The basketball backboard assembly of claim 1 wherein said rear frame includes at least one positioning member locating said rebound member in a predetermined position relative to said rear frame.

18. The basketball backboard assembly of claim 17 wherein said positioning member comprises at least one structure selected from the group consisting essentially of a recessed portion formed within said rear frame and a ridge formed integrally with and projecting from said rear frame.

19. The basketball backboard assembly of claim 18 wherein at least one of said recessed portion and ridge extends completely around the peripheral edge of said rebound member.

20. The basketball backboard assembly of claim 1 wherein said rear frame has an outer periphery and said front frame includes a flange extending around at least a portion of said outer periphery.

21. The basketball backboard of claim 1 wherein said rear frame includes an integrally formed rear alignment member and said front frame including an integrally formed front alignment member, said front and rear alignment members cooperating to locate said front and rear members in a predetermined position relative to each.

22. The basketball backboard of claim 21 wherein said rear alignment member comprises at least one of a recess and a projection, said front alignment member comprising at least one of the other of a groove and projection, with said at least one projection being received in said at least one groove.

23. The basketball backboard assembly of claim 1 further comprising:

at least one boss projecting from said front frame;

at least one bore located in said rear frame whereby said at least one bore receives said at least one boss when said front and rear frames are joined; and at least one fastener extending through said receiving bore and said fastening boss to join the front and rear frames.

24. The basketball backboard assembly of claim 1 wherein said rear frame includes a mounting apparatus for attaching a support member to mount the backboard on a pole.

25. The basketball backboard assembly according to claim 24 wherein said mounting apparatus includes a slot formed in a rear surface of said rear frame member, said slot being of predetermined extent less than the extent of the rear frame and adapted to receive a fastener for mounting the backboard assembly on a support member.

26. A method for making a basketball backboard assembly comprising the steps of:

(a) providing a rebound member having a rebound surface, a peripheral edge extending about the periphery of said rebound member, and an interior portion disposed within the periphery;

(b) providing a molded plastic frame for supporting the rebound member, the frame comprising a unitary molded plastic front frame member and a unitary molded plastic rear frame member, the rear frame member cooperating with the front frame member to support the rebound member about substantially all of the peripheral edge, wherein the molded plastic frame comprises at least one interior support beam, and wherein said interior support beam supports at least part of the interior portion of said rebound member;

(c) disposing the rebound member in a predetermined position in said frame by vertically moving one of the rebound member and the frame relative to the other; and (d) securing the rebound member to the frame.

27. The method of claim 26 wherein the step of disposing the rebound member in the frame comprises positioning the peripheral edge of the rebound member inside the profile of the frame.

28. The method of claim 26 wherein the step of providing a rebound member comprises providing a substantially planar sheet of material formed from at least one material selected from the group consisting of: (i) acrylic, lexan, and similar plastic; (ii) fiberglass; (iii) laminate; (iv) wood; (v) metal; and (vi) tempered glass.

29. The method of claim 26 wherein the step of securing the rebound member to the frame comprises joining the front and rear frame members together such that the rebound member is retained between the front and rear frame members.

30. The method of claim 26 wherein at least one of the front and rear frame members is formed from at least one material selected from the group consisting of injection molded plastic, fiberglass reinforced plastic, structurally foamed plastic, and plastic made with gas assist.

31. The method of claim 29 wherein the step of securing the rebound member comprises vertically moving the front frame relative to the rear frame.

32. The basketball backboard assembly of claim 1 wherein said molded plastic frame is formed by an injection molding process.

33. The basketball backboard assembly of claim 1 wherein said molded plastic frame is formed by a compression molding process.

34. The basketball backboard assembly of claim 1 wherein said molded plastic frame is formed by a blow molding process.

35. The basketball backboard assembly of claim 1 wherein said molded plastic frame is formed by a roto-molding process.

36. The method of claim 26 wherein at least one of the front and rear frame members is formed by an injection molding process.

37. The method of claim 26 wherein at least one of the front and rear frame members is formed by a compression molding process.

38. The method of claim 26 wherein at least one of the front and rear frame members is formed by a blow molding process.

39. The method of claim 26 wherein at least one of the front and rear frame members is formed by a roto-molding process.

* * * * *

UNITED STATES PATENT AND TRADEMARK OFFICE

CERTIFICATE OF CORRECTION

PATENT NO. : 6,004,231
DATED : December 21, 1999
INVENTOR(S) : Randy R. SCHICKERT, *et al.*

It is certified that error appears in the above-identified patent and that said Letters Patent is hereby corrected as shown below:

In column 12, line 11, delete "w thin" and insert –within–.

Signed and Sealed this

Eighth Day of August, 2000

*Attest:*

Q. TODD DICKINSON

*Attesting Officer*

*Director of Patents and Trademarks*